US008304023B2

(12) United States Patent
Wierer et al.

(10) Patent No.: US 8,304,023 B2
(45) Date of Patent: Nov. 6, 2012

(54) TREATMENT OF FIBERFILL FIBERS WITH AQUEOUS DISPERSIONS OF ORGANOPOLYSILOXANES

(75) Inventors: Konrad Alfons Wierer, Burghausen (DE); Otto Schneider, Burghausen (DE)

(73) Assignee: Wacker Chemie AG, Munich (DE)

( * ) Notice: Subject to any disclaimer, the term of this patent is extended or adjusted under 35 U.S.C. 154(b) by 628 days.

(21) Appl. No.: 11/936,279

(22) Filed: Nov. 7, 2007

(65) Prior Publication Data

US 2008/0107814 A1 May 8, 2008

(30) Foreign Application Priority Data

Nov. 8, 2006 (DE) ..... 10 2006 052 730

(51) Int. Cl.
*B05D 3/02* (2006.01)

(52) U.S. Cl. ..... 427/387; 427/384; 427/385.5

(58) Field of Classification Search ..... 427/387, 427/384, 385.5

See application file for complete search history.

(56) References Cited

U.S. PATENT DOCUMENTS

2008/0033062 A1* 2/2008 Herzig et al. ..... 516/55

FOREIGN PATENT DOCUMENTS

| | | | |
|---|---|---|---|
| DE | 24 20 151 | A1 | 11/1974 |
| DE | 35 03 457 | A1 | 8/1986 |
| DE | 10 2004 023 911 | A1 | 1/2005 |
| DE | 10 2004 038 148 | A | 3/2006 |
| EP | 0 510 631 | A1 | 10/1992 |
| EP | 0 655 475 | A1 | 5/1995 |
| EP | 1 096 059 | A1 | 5/2001 |
| GB | 1 458 319 | | 12/1976 |
| GB | 1 458 319 | A | 12/1976 |
| JP | 06330464 | A | 11/1994 |
| JP | 2002194673 | A | 7/2002 |
| WO | 96/37556 | | 11/1996 |
| WO | 2005/100453 | A1 | 10/2005 |
| WO | 2006/015740 | A1 | 2/2006 |

OTHER PUBLICATIONS

English Abstract of WO 2006/015740 A1.
English Abstract of DE 10 2004 038 148 A1.
English Abstract of WO 96/37556.
English Abstract of EP 0 655 475 A1.
English Abstract of DE 35 03 457 A.
English Abstract of DE 10 2004 023 911 A1.
English Abstract of WO 2005/100453 A1.
"Facile Cleavage of Si-C Bonds during the Sol-Gel Hydrolysis of Aminomethyltrialkoxysilanes—A New Method for the Methylation of Primary Amines," Augustin Adima et al., Eur. J. Org. Chem. 2004, pp. 2582-2588, Feb. 6, 2004.
"Emulsions", Rudolf Heusch, Bayer AG, Leverkusen, Standard Article in Ullmann's Encyclopedia of Industrial Chemistry, online posting by Wiley-VCH Verlag GmbH & Co., Jun. 15, 2000.

* cited by examiner

*Primary Examiner* — Robert S Walters, Jr.
(74) *Attorney, Agent, or Firm* — Brooks Kushman P.C.

(57) ABSTRACT

Fiberfill fibers are treated with aqueous dispersions of organopolysiloxanes obtained by reaction of condensation-curable organopolysiloxanes with silanes $$(R^3O)_3SiCR^2{}_2—Y$$

or their hydrolyzates, where $R^2$ is hydrogen or a monovalent lower alkyl radical, $R^3$ is an alkyl radical, Y is —$NHR^4$, —$NR^4{}_2$ or —$NR^5$ in the presence of water, emulsifier and optionally further silanes $$(R^3O)_xR_{3-x}Si—R^6—Z$$

or their hydrolyzates, where $R^6$ is a divalent $C_{2-18}$ hydrocarbyl radical and Z is an amino or aminoalkylamino, epoxy, or (meth)acryloyloxy radical, and x is 1, 2 or 3, and optionally further materials which do not take part in the reaction, wherein no metal-containing catalysts are used and that the organopolysiloxanes and silanes are used in such amounts that the organopolysiloxanes, after removal of water, form elastomeric films insoluble in toluene.

14 Claims, No Drawings

TREATMENT OF FIBERFILL FIBERS WITH AQUEOUS DISPERSIONS OF ORGANOPOLYSILOXANES

BACKGROUND OF THE INVENTION

1. Field of the Invention

This invention relates to a process for treating fiberfill fibers with aqueous dispersions of organopolysiloxanes.

2. Background Art

Emulsions of crosslinked silicones are known. Catalysts comprising (heavy) metals or free of metals are required for crosslinking silicones in addition to crosslinkers. In some cases, inhibitors are also used to control reactivity and pot life in order that any unwanted, premature gelling may be prevented.

Metal-free aqueous RTV1 dispersions are described in EP 828 794 A and EP 655 475 A1. They are obtainable using the three starting components:

(A) organopolysiloxanes comprising condensation-capable groups, (B) (amine-free) organosilicon compounds acting as crosslinkers in that they have at least 3 crosslinking-reactive groups, (C) organosilicon compounds comprising basic nitrogen, more preferably the alkali metal siliconates of the compound, which are catalytically active.

Component (C) confers a very high pH of the products, which presents difficulties in processing.

DE 102004038148 A1 (equivalent to WO 2006/015740 A1) describes the preparation of high-viscosity silicones (10,000 to 50,000,000 mPa·s) in emulsion by reaction of silanol-terminated organopolysiloxanes with α-aminomethylalkoxysilanes. However, no elastomeric silicone films insoluble in toluene are obtained.

EP 510 631 A describes the preparation and the finishing with a fiber-finishing agent based on copolyesters grafted with polyorganosiloxanes, for a soft featherlike hand for polyester fiberfill fibers. The lateral grafting of polyorganosiloxanes onto the polyester backbone gives a finishing agent which produces a smooth, low-friction hand on fibers, in particular polyester fiberfill fibers.

GB 1458319A (equivalent to DE 24 20 151 A) describes novel manufactured fibers and a process for their production wherein a reactive polysiloxane is used in combination with aminoalkoxysilane and a curing agent, a metal salt of 2- to 4-valent metal ions, such as dibutyltin diacetate or zinc acetate, under heat treatment of 120 to 200° C.

DE 35 03 457 A discloses a process for impregnating organic fibers wherein an organopolysiloxane having amino groups, such as aminoethylaminopropyl groups, is crosslinked with hydrosiloxane in the presence of metal-containing catalysts, such as dibutyltin dilaurate.

EP 1 096 059 A describes an aqueous emulsion for treating polyester fibers which contains a mixture of an emulsion of an amino-functional organopolysiloxane having alkoxy groups and an emulsion of an amino-functional organopolysiloxane having hydroxyl groups. The two organopolysiloxanes first have to be prepared by reaction of α,ω-dihydroxydimethylpolysiloxanes with N-(2-aminoethyl)(3-aminopropyl)methyldimethoxysilane or by reaction of α,ω-dihydroxydimethylpolysiloxanes or cyclic dimethylpolysiloxanes with the hydrolysis or condensation product of N-(2-aminoethyl)(3-aminopropyl)methyldimethoxysilane, respectively. High molecular weight linear polysiloxanes are obtained, but not crosslinked films insoluble in toluene.

SUMMARY OF THE INVENTION

The present invention has for its object to provide a process for treating fiberfill fibers with aqueous dispersions of organopolysiloxanes without use of metal-containing catalysts. A further object of the present invention was to provide a process for treating fiberfill fibers with aqueous dispersions of organopolysiloxanes wherein the aqueous dispersions of organopolysiloxanes form elastomeric films insoluble in toluene after the water has been removed and this treatment endows the fiberfill fibers with a permanent soft hand and good bulk, and to provide a process for treating fiberfill fibers with aqueous dispersions of organopolysiloxanes wherein the dispersions are obtained by a simple process, wherein no costly or inconvenient chemical reactions have to take place, wherein the treatment of the fiberfill fibers can be effected using short residence times and wherein the treatment of the fiberfill fibers can take place at low temperatures as well as at high temperatures and the fiberfill fibers thus treated exhibit less or lower yellowing. The present invention has, as a further object, to provide aqueous dispersions of organopolysiloxanes for treatment of fiberfill which are finely divided, stable and preferably pH-neutral (pH range about 5-9) and which are free or almost free of volatile organic compounds (VOCs). These and other objects are achieved by the present invention, wherein crosslinkable organopolysiloxanes are crosslinked with the aid of trialkoxyaminomethylsilanes.

DETAILED DESCRIPTION OF THE PREFERRED EMBODIMENT(S)

The present invention accordingly provides a process for treating fiberfill fibers with aqueous dispersions of organopolysiloxanes obtainable by reaction of organopolysiloxanes (1) comprising condensation-capable groups and units of the general formula $$R_a(OR^1)_bSiO_{\frac{4-(a+b)}{2}} \quad (1)$$

where

R is a hydrogen atom or a monovalent hydrocarbyl radical of 1 to 18 carbon atoms which is optionally substituted with the heteroatoms N and/or O, $R^1$ is a hydrogen atom or an alkyl radical with 1 to 8 carbon atoms, preferably a hydrogen atom or a methyl or ethyl radical, a is 0, 1, 2 or 3, and b is 0, 1 or 2, with the proviso that the sum a+b is ≦3 and the organopolysiloxane (1) contains on average at least one $OR^1$ radical, preferably in the meaning of $R^1$ as a hydrogen atom, per molecule, with silanes (2) of the general formula $$(R^3O)_3SiCR^2_2—Y \quad (II)$$

or their hydrolyzates, where $R^2$ is a hydrogen atom or a monovalent alkyl radical of 1 to 4 carbon atoms, preferably a hydrogen atom, $R^3$ is an alkyl radical having 1 to 8 carbon atoms per radical, Y is a radical of the formula —$NHR^4$, —$NR^4_2$ or —$NR^5$, where $R^4$ is a monovalent hydrocarbyl radical of 1 to 18 carbon atoms which optionally contains nitrogen and/or oxygen atoms, and $R^5$ is a divalent hydrocarbyl radical of 3 to 12 carbon atoms which optionally contains nitrogen and/or oxygen atoms, in the presence of water (3), emulsifier (4)

and optionally further silanes (5) of the general formula $$(R^3O)_xR_{3-x}Si—R^6—Z \quad (III)$$

or their hydrolyzates, where $R^6$ is a divalent hydrocarbyl radical of 2 to 18 carbon atoms and Z is a radical selected from the group consisting of amino or aminoalkylamino radicals, epoxy radicals and (meth)acryloyloxy radicals, and x is 1, 2 or 3, preferably 2 or 3, and optionally further materials (6) which do not take part in the reaction of organopolysiloxane (1) with silane (2), with the proviso that no metal-containing catalysts are used and that the organopolysiloxanes (1) and silanes (2) are used in such amounts that the organopolysiloxanes after removal of water (3) form elastomeric films insoluble in toluene.

It is surprising that a simple reaction of just 2 components—unlike the two reactions in EP 1 096 059 A and also unlike the reaction described in DE 10 2004 038 148 A, provides aqueous dispersions of high molecular weight, partially crosslinked particles of polymer which, after removal of water, preferably by evaporation, provide an elastic film with formation of a high molecular weight elastic network and endow the fiberfill fibers treated therewith with a permanent soft hand.

In the process of the present invention, the reaction of organopolysiloxane (1) with silane (2) can be carried out not only before the emulsion is produced but also by initially emulsifying the organopolysiloxane (1) which then reacts in emulsion droplets with the silane (2).

The dispersions of the present invention contain precrosslinked organopolysiloxanes which, after removal of water, form elastomeric films containing crosslinked organopolysiloxanes comprising high molecular weight branched or dendrimerlike ultrabranched structures. No viscosity measurement is possible on these elastomeric films. The polymeric siloxane networks of the elastomeric films are typically insoluble in organic solvents, such as toluene, although they may possibly swell therein, which for the purposes of this invention is likewise to be understood as insoluble. This is in contrast to uncrosslinked organopolysiloxanes which can also be highly viscous but for which a viscosity measurement is possible and which are soluble in organic solvents, such as toluene.

It is surprising that aqueous dispersions of crosslinked organopolysiloxanes are obtainable by this process because it is stated in A. Adima et. al., Eur. J. Org. Chem. 2004, 2582-2588 that α-aminomethyltrialkoxysilanes decompose in the presence of water to form $SiO_2$ and the corresponding methylated amine.

Preferably, the dispersions of the present invention are aqueous suspensions or aqueous emulsions of organopolysiloxanes.

The dispersions of the present invention form an elastic network of silicone as they dry without addition of catalyst or change in pH. Preferably only two (mutually reacting) components are required to prepare the crosslinked organopolysiloxanes of the present invention: organopolysiloxanes (1) having condensation-capable groups, and crosslinkers (2). These components preferably react with each other at as low a temperature as room temperature. No metal-containing additional catalysts are required to support this reaction. The reaction further preferably proceeds in the neutral range, i.e., in the pH range of about 5 to 9, which results autogenously due to the components themselves. Moreover, the high reactivity means that there is no need for specific management of the chemical reaction, nor preferably for any heating.

The dispersion of the present invention is notable for its high stability in storage, even at elevated temperature, and for its high stability to shearing. The process of the present invention has the advantage that dispersions of high solids content and filler content can be obtained. The nonvolatiles content of the dispersion is preferably about 1% to 99% by weight, preferably 30% to 95% by weight and more preferably greater than 50% by weight, based on the total weight of the dispersion.

The process of the present invention does not utilize any metal-containing catalysts; that is, preferably no transition metals of transition group VIII of the periodic table and their compounds and no metals of main groups III, IV and V of the periodic table or their compounds are used. The elements C, Si, N, and P do not count as metals in this definition.

Examples of hydrocarbyl radicals R are alkyl radicals such as methyl, ethyl, n-propyl, isopropyl, 1-n-butyl, 2-n-butyl, isobutyl, tert-butyl, n-pentyl, isopentyl, neopentyl, and tert-pentyl radicals; hexyl such as n-hexyl; heptyl such as n-heptyl; octyl such as n-octyl and isooctyl such as 2,2,4-trimethylpentyl; nonyl such as n-nonyl; decyl such as n-decyl; dodecyl such as n-dodecyl; octadecyl such as n-octadecyl; cycloalkyl such as cyclopentyl, cyclohexyl, cycloheptyl and methylcyclohexyl; alkenyl such as vinyl, 5-hexenyl, cyclohexenyl, 1-propenyl, allyl, 3-butenyl and 4-pentenyl; aryl such as phenyl, naphthyl, anthryl and phenanthryl; alkaryl such as o-, m-, p-tolyl; xylyl and ethylphenyl; and aralkyl such as benzyl, α-phenylethyl and β-phenylethyl. Preference for use as R radical is given to methyl, ethyl, octyl and phenyl, with methyl and ethyl being particularly preferred.

Examples of N- or O-substituted hydrocarbon radicals R are hydrocarbyl radicals substituted with amino groups and polyoxyethylene or polyoxypropylene or polyoxyethylenepolyoxypropylene groups.

Examples of amino-substituted radicals R are radicals of the formula —$R^6$—$NR^7_2$, where $R^6$ is as defined above and each $R^7$ is the same or different and represents a hydrogen atom or an alkyl or aminoalkyl or iminoalkyl radical. N-(2-Aminoethyl)(3-aminopropyl) is a preferred example.

Preferably, $R^1$ is a hydrogen atom. Examples of alkyl $R^1$ are the alkyl radicals recited above for R, and methyl and ethyl are preferred. Preferably, $R^2$ is a hydrogen atom. Examples of alkyl radicals R having 1 to 8 carbon atoms also apply in full to alkyl radicals $R^3$. Preferred examples of alkyl radicals $R^3$ are the methyl and ethyl radical.

Examples of hydrocarbyl radicals R, such as alkyl, cycloalkyl, aryl, alkaryl and aralkyl radicals, hold in full for hydrocarbyl radicals $R^4$. Preferred examples of alkyl radicals $R^4$ are methyl, ethyl, butyl, hexyl, and octyl radicals, and a preferred example of a cycloalkyl radical $R^4$ is the cyclohexyl radical.

A preferred example of $R^5$ is the radical of the formula —$CH_2$—$CH_2$—O—$CH_2$—$CH_2$, while preferred examples of Y radicals are morpholino, piperazino, piperidino and cyclohexylamino radicals. Preferably, $R^6$ is an alkylene radical, more preferably a radical of the formula —$CH_2CH_2CH_2$—. Preference for organopolysiloxanes (1) is given to siloxanes of the general formula $$(R^1O)R_2SiO(SiR_2O)_eSiR_2(OR^1) \quad (IV),$$

where R and $R^1$ are each as defined above and e is an integer from 1 to 1000, with the proviso that 25 to 100% and preferably 50 to 100% of all $R^1$ radicals are hydrogen atoms. Further examples of organopolysiloxanes (1) are resins of the general formula $$[(R_3SiO_{1/2})_f(R_2SiO_{2/2})_g(R_1SiO_{3/2})_h(SiO_{4/2})_k] \quad (V)$$

where R is as defined above and additionally R in formula (V) can also be ($OR^1$) as defined above, with the proviso that at least one —$OR^1$, where $R^1$ is a hydrogen atom, is present per molecule, f, g, h and k are each an integer from 0 to 1000 and h/(f+g+h+k) is preferably >0.2.

Examples of siloxanes (1) are commercially available polydimethylsiloxanes having terminal silanol groups and polydimethylsiloxanes having terminal alkoxy groups. Further examples of siloxanes (1) are commercially available functionalized siloxanes, such as amine oils, for example amine oils having 3-(2-aminoethyl)aminopropyl functions, glycol oils, phenyl or phenylmethyl oils containing silanol or alkoxy groups. Further examples of organopolysiloxanes (1) are resinous siloxanes, such as methylsilicone resins, having 80 mol % of $CH_3SiO_{3/2}$ and 20 mol % of $(CH_3)_2SiO_{2/2}$ and a molar mass of about 5000 g/mol or 98 mol % of $CH_3SiO_{3/2}$ and 2 mol % of $(CH_3)_2SiO_{2/2}$ and a molar mass of about 5000 g/mol, or for example methylphenyl silicone resins having 65 mol % of $C_6H_5SiO_{3/2}$ and 35 mol % of $(CH_3)_2SiO_{2/2}$, whose remaining free valences bear $R^1O$— groups of the abovementioned meanings.

These compounds are commercially manufactured in large volumes, and are available at very low cost, so that the dispersions used in the process of the present invention can likewise be produced at low cost.

The dispersions can be produced using one kind of organopolysiloxane (1) or different kinds of organopolysiloxane (1). The organopolysiloxanes (1) preferably have viscosities in the range from 1 mPa·s to 5,000,000 mPa·s at 25° C., preferably 50 mPa·s to 100,000 mPa·s at 25° C. and more preferably 100 mPa·s to 10,000 mPa·s at 25° C.

The present invention's process for preparing the dispersion can utilize one kind of silane (2) or different kinds of silane (2). Preferably, the —$CR^2_2$—Y radical in silane (2) of formula (II) is a radical of formula —$CH_2$—Y. Examples of —$CR^2_2$—Y radicals in silane (2) of formula (II) are aminomethyl, methylaminomethyl, dimethylaminomethyl, diethylaminomethyl, dibutylaminomethyl, cyclohexylaminomethyl, morpholinomethyl, piperidinomethyl, piperazinomethyl, ((diethoxymethylsilyl)methyl)cyclohexylaminomethyl, ((triethoxysilyl)methyl)cyclohexylaminomethyl, anilinomethyl, 3-dimethylaminopropylaminomethyl and bis(3-dimethylaminopropyl)aminomethyl.

Examples of silanes (II) are dibutylaminomethyltriethoxysilane, dibutylaminomethyltributoxysilane, cyclohexylaminomethyltrimethoxysilane, cyclohexylaminomethyltriethoxysilane, anilinomethyltriethoxysilane, morpholinomethyltriethoxysilane, morpholinomethyltrimethoxysilane, morpholinomethyltriisopropoxysilane, 3-dimethylaminopropylamino-methyltrimethoxysilane, ethylcarbamoylmethyltrimethoxysilane, morpholinomethyltributoxysilane, morpholinomethyltrialkoxysilane, where the alkoxy radical is a $C_1$-$C_4$-alkoxy radical, in particular a mixture of methoxy and ethoxy, bis(dimethylaminopropyl)aminomethyltriethoxysilane, diisopropylaminomethyltriethoxysilane, piperazinomethyltriethoxysilane, piperidinomethyltriethoxysilane bis(diethoxymethylsilylmethyl)cyclo-hexylamine, bis(triethoxysilylmethyl)cyclohexylamine, and morpholino-methyltri(2-hydroxyethoxy)silane. Preference is given to silanes (2) of formula (II) wherein the ($R^3O$)— radical is an ethoxy group.

The silanes (2) of formula (II) may contain up to 30% by weight of difunctional silanes of formula $$(R^3O)_2RSiCR^2_2—Y \quad (II')$$

or their hydrolyzates.

The silane of formula (II') has a chain-extending effect for organopolysiloxanes (1), but does not disrupt the crosslinking reaction of silane of formula (II) with the chain-extended organopolysiloxane (1). Crosslinked organopolysiloxanes in accordance with the present invention are obtained. The degree of crosslinking depends on the starting ratio of the equivalents of —$OR^3$ in silane (2) of formula (II) to —OR' in organopolysiloxane (1) of formula (I).

The dispersions of the present invention are prepared from organopolysiloxane (1) and silane (2) by using silane (2) or its partial hydrolyzates preferably in amounts of at least 0.6 equivalent of —$OR^3$, preferably at least 0.7 equivalent of —$OR^3$, more preferably 0.6 to 2 equivalents of —$OR^3$, especially 0.65 to 1 equivalent of —$OR^3$, and even more preferably 0.7 to 0.99 equivalent of —$OR^3$, per equivalent of —$OR^1$ in organopolysiloxane (1), where $R^1$ in (1) is preferably a hydrogen atom.

The crosslink frequency depends not only on the chain lengths of the organopolysiloxanes (1) but also on the stoichiometry of the mutually reacting $SiOR^1$ groups of organopolysiloxane (1) and the $SiOR^3$ groups of silane (2). High degrees of crosslinking are achieved when equal numbers of the $SiOR^1$ groups of organopolysiloxane (1) and $SiOR^3$ groups of silane (2) react with each other. Losses due to volatility or secondary reactions may for this purpose require a stoichiometric ratio other than 1.0:1.0. If desired, a stoichiometric excess of $SiOR^3$ groups from silane (2) to $SiOR^1$ groups from organopolysiloxane (1) can be used. It was determined that, surprisingly, elastic films are obtainable even from a stoichiometric deficiency of $SiOR^3$ groups from silane (2) to $SiOR^1$ groups from organopolysiloxane (1), for example 0.7:1.0.

The dispersions of the present invention are produced by intensive mixing of organopolysiloxanes (1) with silanes (2), water (3), emulsifiers (4), if appropriate further silanes (5), and if appropriate further materials (6). Production can be batchwise or continuous, as described for example in DE 102004023911 A or equivalently WO 2005100453.

Technologies for producing dispersions or emulsions of organopolysiloxanes are known. The intensive mixing and dispersing can take place in rotor-stator stirrers, colloid mills, high-pressure homogenizers, microchannels, membranes, jet nozzles and the like, or ultrasonically. Homogenizing instruments and processes are described for example in Ullmann's Encyclopedia of Industrial Chemistry, CD-ROM edition 2003, Wiley-VCH, under the headword of "Emulsions".

Although the silanes (2) are known to contain hydrolysis-sensitive groups, particularly when $R^3$ is a hydrogen atom or a methyl or ethyl radical, surprisingly crosslinked organopolysiloxanes are obtained even in the presence of water by reaction with two or more organopolysiloxanes (1).

The manner of mixing the components to produce the dispersions of the present invention is not very critical, and can be performed in various orders. However, depending on the components (1), (2), (3), (4), if appropriate (5) and if appropriate (6), there may be preferred procedures which should be examined in the individual case.

For example, components (1) and (2) can be premixed with each other, then the emulsifier(s) (4) added and thereafter the water (3) and if appropriate further materials (5) and (6) be incorporated. It is also possible to meter the components (1) and (2) and also (3) to (6) into the emulsifying apparatus in succession. In particular cases, it can be advantageous, for example owing to the siloxane viscosity or reactivity, to mix silane (2) with an organopolysiloxane (1) and thereafter to incorporate another organopolysiloxane (1), or vice versa, depending on what results in better rheological properties for processing the components.

In the case of very reactive silanes (2), it can be advantageous first to convert component (1) with emulsifier (4) and the water (3) into a stiff phase and thereafter to meter the silane (2) pure or diluted in an inert material (6) before, if appropriate, further dilution with water.

It is also possible to add silane (2) into the final emulsion of organopolysiloxanes (1) in order that the desired reaction and crosslinking of the organopolysiloxane (1) in the emulsion may thereby be achieved. The silane (2) may further be partially or completely hydrolyzed beforehand, by addition of water. To obtain VOC-free hydrolyzate of silane (2), the by-product alcohol $R^3OH$ can be partially or completely removed by suitable known measures such as distillation, membrane processes or other separation processes.

The process of the present invention preferably employs water (3) in amounts of 1% to 99% by weight and more preferably 5% to 95% by weight, all based on the total weight of all ingredients of the dispersion.

Preferably, the process for producing dispersions can be carried out continuously. Preferably, the organopolysiloxanes (1) required for preparing the dispersion are prepared continuously and forwarded continuously to the emulsifying apparatus and, before emulsification, are mixed continuously with silanes (2), emulsifiers (4) and at least some of the water as dispersion medium (3), and this mixture is fed continuously to a first high-shear mixer and a viscous phase is formed in the mixer, the pressure and temperature downstream of the mixture being measured and closed-loop controlled such that a qualitatively high-value and very finely divided dispersion is produced. Further silanes (5) and further materials (6) can be added upstream or downstream of the first high-shear mixer. If appropriate, the emulsion downstream of the first high-shear mixer can be further diluted by admixture of water.

The process of the present invention may utilize as emulsifiers (4) any ionic or nonionic emulsifiers (not only individually but also as mixtures of different emulsifiers) with which aqueous dispersions, in particular aqueous emulsions of organopolysiloxanes, can be obtained.

Examples of anionic emulsifiers are:

1. Alkyl sulfates, particularly those having a chain length of 8 to 18 carbon atoms, alkyl and alkaryl ether sulfates having 8 to 18 carbon atoms in the hydrophobic radical and 1 to 40 ethylene oxide (EO) or propylene oxide (PO) units.

2. Sulfonates, particularly alkyl sulfonates having 8 to 18 carbon atoms, alkylaryl sulfonates having 8 to 18 carbon atoms, taurides, esters and monoesters of sulfosuccinic acid with monohydric alcohols or alkylphenols having 4 to 15 carbon atoms; if appropriate, these alcohols or alkylphenols may also be ethoxylated with 1 to 40 EO units.

3. Alkali metal and ammonium salts of carboxylic acids having 8 to 20 carbon atoms in the alkyl, aryl, alkaryl or aralkyl radical.

4. Phosphoric partial esters and their alkali metal and ammonium salts, particularly alkyl and alkaryl phosphates having 8 to 20 carbon atoms in the organic radical, alkyl ether or alkaryl ether phosphates having 8 to 20 carbon atoms in the alkyl or alkaryl radical and 1 to 40 EO units.

Examples of nonionic emulsifiers are:

5. Polyvinyl alcohol still having 5 to 50% and preferably 8 to 20% of vinyl acetate units and a degree of polymerization in the range from 500 to 3000.

6. Alkyl polyglycol ethers, preferably those having 3 to 40 EO units and alkyl radicals of 8 to 20 carbon atoms.

7. Alkyl aryl polyglycol ethers, preferably those having 5 to 40 EO units and 8 to 20 carbon atoms in the alkyl and aryl radicals.

8. Ethylene oxide/propylene oxide (EO/PO) block copolymers, preferably those having 8 to 40 EO and/or PO units.

9. Addition products of alkylamines having alkyl radicals of 8 to 22 carbon atoms with ethylene oxide or propylene oxide.

10. Fatty acids having 6 to 24 carbon atoms.

11. Alkylpolyglycosides of the general formula R*—O—$Z_o$, where R* is a linear or branched, saturated or unsaturated alkyl radical having on average 8-24 carbon atoms and $Z_o$ is an oligoglycoside radical having on average o=1-10 hexose or pentose units or mixtures thereof.

12. Natural materials and their derivatives, such as lecithin, lanolin, saponines, cellulose; cellulose alkyl ethers and carboxyalkylcelluloses whose alkyl groups each have up to 4 carbon atoms.

13. Linear organo(poly)siloxanes containing polar groups, containing in particular the elements O, N, C, S, P, Si, particularly those linear organo(poly)siloxanes having alkoxy groups with up to 24 carbon atoms and/or up to 40 EO and/or PO groups.

Examples of cationic emulsifiers are:

14. Salts of primary, secondary and tertiary fatty amines having 8 to 24 carbon atoms with acetic acid, sulfuric acid, hydrochloric acid and phosphoric acids.

15. Quaternary alkyl- and alkylbenzeneammonium salts, in particular those whose alkyl groups have 6 to 24 carbon atoms, particularly the halides, sulfates, phosphates and acetates.

16. Alkylpyridinium, alkylimidazolinium and alkyloxazolinium salts, in particular those whose alkyl chain has up to 18 carbon atoms, specifically the halides, sulfates, phosphates and acetates.

Useful ampholytic emulsifiers include in particular:

17. Amino acids with long-chain substituents, such as N-alkyldi(aminoethyl)glycine or N-alkyl-2-aminopropionic acid salts.

18. Betaines, such as N-(3-acylamido-propyl)-N,N-dimethylammonium salts having a $C_8$-$C_{18}$-acyl radical and alkylimidazolium betaines.

Preference for emulsifiers is given to nonionic emulsifiers, in particular the alkyl polyglycol ethers recited above under 6. The constituent (4) can consist of one of the abovementioned emulsifiers or of a mixture of two or more of the abovementioned emulsifiers, it can be used in pure form or as solutions of one or more emulsifiers in water or organic solvents.

The process of the present invention preferably utilizes the emulsifiers (4) in amounts of 0.1% to 60% by weight and more preferably 0.5% to 30% by weight, all based on the total weight of organopolysiloxanes (1) and silanes (2). When the organopolysiloxane (1) or the silane (2) or the resulting crosslinked organopolysiloxane itself acts as an emulsifier, the addition of separate emulsifiers (4) can be dispensed with, if desired.

Further silanes (5) of formula (III) can be used in the preparation of the dispersions of the present invention. Silanes (5) act as adhesion-promoting silanes. They can be used in addition to silane (2) and in the case of x=3 can act as additional crosslinkers.

Z in formula (III) is preferably a radical of formula —$NR^7_2$, where each $R^7$ is the same or different and represents a hydrogen atom or an alkyl or aminoalkyl or iminoalkyl radical. A preferred example of the Z radical is the radical of the formula —$NH(CH_2)_2NH_2$. Preferably, x is 2, and preferably, $R^6$ in formula (III) is a radical of formula —$CH_2CH_2CH_2$—.

Examples of silanes (5) are (3-methacryloxypropyl)trimethoxysilane, 3-aminopropyltrimethoxysilane, 3-(cyclohexylamino)propyltrimethoxysilane N-(2-aminoethyl)(3-aminopropyl)methyldimethoxysilane, N-(2-aminoethyl)(3-aminopropyl)methyldimethoxysilane, N-(2-aminoethyl)(3-aminopropyl)trimethoxysilane, N-(2-aminoethyl)(3-aminopropyl)triethoxysilane and (3-glycidoxypropyl) triethoxysilane.

Examples of water-miscible liquids useful as further materials (6) are acids, such as formic acid, acetic acid, propionic acid, oxalic acid and citric acid and silicone- or non-silicone-containing emulsions. Useful further materials (6) further include commercially available preservatives for dispersions, such as isothiazolinones or parabens, or their aqueous formulations.

The dispersions can be produced as dispersions of undiluted crosslinked organopolysiloxanes, but a dilution with organic solvents or low-viscosity oligomers/polymers is sometimes advisable for handling reasons. Examples of water-immiscible liquids useful as further materials (6) are therefore organic solvents such as toluene, n-hexane, n-heptane and technical-grade benzine fractions and low-viscosity oligomers/polymers, such as silicone oils, preferably siloxanes such as dimethylpolysiloxanes.

Examples of water-soluble solids useful as further materials (6) are ammonium phosphates and polyphosphates, ammonium formates and lithium formate, which can act as antistats and/or flame retardants.

Examples of water-insoluble solids useful as further materials (6) are reinforcing and nonreinforcing fillers, particularly flame-retardant fillers. Examples of reinforcing fillers, i.e., fillers having a BET surface area of at least 50 $m^2/g$, are fumed silica, precipitated silica or silicon-aluminum mixed oxides having a BET surface area of more than 50 $m^2/g$ and silicone particles, such as MQ resins. The fillers mentioned may be in a hydrophobicized state. Examples of nonreinforcing and partly also flame-inhibiting fillers, i.e., fillers having a BET surface area of less than 50 $m^2/g$, are powders of quartz, chalk, cristobalite, diatomaceous earth, calcium silicate, zirconium silicate, montmorillonites, such as bentonites, zeolites, metal oxides, such as aluminum oxide or zinc oxide or mixed oxides thereof or titanium dioxide, metal hydroxides, such as aluminum hydroxide, barium sulfate, calcium carbonate, gypsum, silicon nitride, silicon carbide and boron nitride.

The emulsifying operation to produce the dispersion is preferably carried out at temperatures below 120° C., more preferably at 5° C. to 100° C. and even more preferably at 10° C. to 80° C. The temperature increase preferably comes about through input of mechanical shearing energy, which is needed for the emulsifying operation. The temperature increase is not needed to speed a chemical process. The dispersion is preferably carried out at the pressure of the ambient atmosphere, but can also be carried out at higher or lower pressures.

The dispersion used for the process of the present invention has the advantage that it can be obtained without addition of catalysts, in particular without addition of metal catalysts. The reaction of (1) with (2) preferably goes to completion within a few minutes to several hours, with methoxysilanes again reacting faster than ethoxysilanes. The condensation can be speeded by means of acids and bases. The alcohols generated as condensation by-products in the course of the preparation of the dispersion can remain in the dispersion or else be removed, for example by vacuum distillation, membrane processes or by extraction.

The average particle size measured in the dispersions by means of light scattering is in the range from 0.001 to 100 μm, preferably in the range from 0.002 to 10 μm. The pH can vary from 1 to 14, preferably from 3 to 9, and more preferably from 5 to 9.

Examples of fiberfill fibers treated with the dispersions of the present invention are those of polyester, polyamide, polylactate (PLA), polybutyric acid, polyolefins, viscose, modal and lyocell. Preference is given to fiberfill fibers of polyester.

The fiberfill fibers are preferably staple fibers or crimpled staple fibers from which a bulky wadding is produced by opening and random-laying on cards. This bulky wadding can be used as batting, fill material or cushioning/padding material in cushions, pillows, padding, blankets, quilts, duvets, mattresses, sleeping bags, insulating apparel (examples being coats, sport anoraks). The fiberfill fibers may be treated by contacting the fiberfill fibers with the dispersions of the present invention by dipping, spraying, rolling, printing, padding or curtain coating, preferably by applying the aqueous dispersions to the fiberfill fibers via spraying, dipping, padding or curtain coating. Thereafter, the water (3) is removed. Preferably, the water is removed by allowing the fiberfill fibers to dry at a temperature of 1 to 230° C., preferably 30 to 180° C. and more preferably in the temperature range from 70 to 120° C. The drying time is dependent on parameters such as, for example, temperature, air circulation, substrate thickness and add-on. After drying, the dispersions of the present invention remain as a film on the surface of the fiberfill fibers.

The process of the present invention has the advantage that the fiberfill fibers treated with the dispersions of the present invention have a permanent soft hand, enhanced elasticity, luster and smoothness, reduced frictional resistance and also improved hydrophobicity and soil rejection. The film obtained from the dispersion by the evaporation of water adheres firmly to the fiberfill fibers and endows the surface of the fiberfill fibers with a particularly soft smoothness and elasticity coupled with resiliency.

Owing to the good permanent adhesion to the fiber, the fiberfill fiber has good carding properties in that there is virtually no rub-off/deposition of silicone polymers on the card clothing which would require the cards to be switched off and an increased cleaning effort.

Operative Methods in Lab:

Film Formation Test:

The amount of emulsion which produces about 1 g of residue is weighed out; for example about 1.5 g in the case of a 66% emulsion and about 2 g in the case of a 50% emulsion. This amount is diluted 1:1 with water and poured into a tinplate lid (10 cm in diameter). The product is distributed over the entire surface by tilting the lid and the sample is placed open in a fume hood (at room temperature for 24 h or in a drying cabinet at 120° C. or 170° C. for 20 min).

The evaluation is performed when the water or solvent has completely evaporated. Ratings from 1 to 5 are awarded (ratings: 1=oily, uncrosslinked, 2=oily, viscid, 3=viscous, incipiently crosslinked, 4=incipiently crosslinked, tacky, 5=firm with tack-free dry surface).

Fiberfill Finish:

For finishing, 117 g of the dispersions described in the inventive and comparative examples were diluted with completely ion-free water to 1000 g and 400 ml thereof were introduced as initial charge into a 11 glass beaker. Crimped polyester staple fibers having a linear density of 61 dtex and a staple length of 50 mm are opened on a card or on a willowing machine to form bulky wadding. 20 g of this fiber are dipped into the glass beaker for 1 minute and completely wetted. The wet fiber is then removed and whizzed in a salad spinner to remove only sufficient liquid to keep a weight increase of 70%. To remove the rest of the water and to complete curing, the moist fibers are placed for 10 min in a drying cabinet (selectively at 120 or 170° C.) or selectively the treated fibers were spread out and dried at 23° C. for 24 hours.

Extraction with Soxhlet Apparatus:

To investigate permanence, 10 g of fiberfill material (with or without silicone finish) were extracted for 3 hours in a 500 ml round-bottomed flask by refluxing with 220 g of hexane and the residue after the hexane had been evaporated was determined.

Production of Film-Forming Silicone Dispersions:

Example 1

In an Ultra-Turrax T 50 emulsifying apparatus (from Janke & Kunkel/IKA), 5 g of isotridecyl decaethoxylate, 85% in water, commercially available under the trade name of Lutensol TO 109 (from BASF) and 8 g of ion-free water are combined to prepare an emulsifier mixture which is admixed with 100 g of a freshly prepared homogeneous siloxane polymer/silane mixture consisting of 99.65 g of polydimethylsiloxanediol containing 1100 weight ppm of terminal OH groups, as siloxane (1), and 0.39 g of N morpholinomethyltriethoxysilane (molar mass 263.4) as silane (2), by metered addition. This is followed by portionwise dilution with altogether 90.1 g of completely ion-free water to obtain a milkily white emulsion having an average particle size of 309 nm. The solids content of the emulsion is 50.7%, the pH is 6.0. The emulsion is homogeneous and stable even after 6 months of storage at room temperature.

When 0.5 g of this emulsion is poured into 8 g of tetrahydrofuran, a precipitate of the crosslinked and THF-insoluble organopolysiloxane elastomer forms immediately. Nor does the precipitate redissolve within 24 h.

Evaporating the emulsion gives after a drying time of 24 h/25° C. a gel-like elastic film which firmly adheres to glass or aluminum.

Examples 2 to 6

Further emulsions are prepared similarly to Example 1, using the amounts reported in table 1.

TABLE 1

| Example | Siloxane (1) in g | Silane (2) in g | Solids content (%) | pH | Particle size (nm) | Film evaluation after drying 24 h/25° C. |
|---|---|---|---|---|---|---|
| B2 | 99.56 (1a) | 0.44 | 50.5 | 7 | 478 | very elastic, transparent |
| B3 | 99.40 (1a) | 0.60 | 49.9 | 7 | 481 | elastic, transparent |

TABLE 1-continued

| Example | Siloxane (1) in g | Silane (2) in g | Solids content (%) | pH | Particle size (nm) | Film evaluation after drying 24 h/25° C. |
|---|---|---|---|---|---|---|
| B4 | 99.22 (1a) | 0.79 | 50.5 | 6.5 | — | elastic, opaque |
| B5 | 94.0 (1a) | 6.0 | 49.8 | 8 | — | not very elastic, opaque |
| B6 | 20.0 (1b) 80.0 (1a) | 0.37 | 52.0 | 7 | 2810 | very elastic, transparent |

The solids content is determined at 150° C. to constant weight using a Mettler Toledo HR 73.

Particle size is determined using a Coulter N4 plus.

Example B6 utilizes two siloxanes (1a, 1b); siloxane (1b) is a copolymer of 3-(2-aminoethylamino)propylmethylsiloxy and dimethylsiloxy units having an amine number of 0.145, a viscosity of 4700 $mm^2/s$ (at 25° C.) and an OH/OMe end group ratio=54/46;

siloxane (1a) used is a polydimethylsiloxanediol containing 1100 weight ppm of terminal OH groups.

Silane (2) used is N-Morpholinomethyltriethoxysilane.

The elasticity of the films produced from the emulsion decreases with increasing amount of silane (2) from B1 to B5.

The elastomeric film produced from the dispersion B3 is cut apart and placed in toluene for 24 h. The cut edges are afterwards still sharp. The film has swollen, but has not dissolved in toluene.

Comparative Tests 1a-1e Corresponding to EP 828 794 A and EP 655 475 A1:

The procedure of Example B3 is repeated except that 0.60 g of morpholinomethyltriethoxysilane, the inventive silane (2), is replaced by the component reported in table 2:

Comparison 1a: 0.60 g of vinyltrimethoxysilane (VTMO) as per Example 1 of EP 828 794 A Comparison 1b: 0.34 g of vinyltrimethoxysilane (molar mass 148.2) (0.34 g=1.1 equivalents of Si—OCH3 of vinyltrimethoxysilane based on 1 equivalent of SiOH of siloxane (1) similarly to Example B3)

Comparison 1c: 0.60 g of α,ω-dimethoxypoly(N-(2-aminoethyl)-3-amino-propylmethylsiloxane) as per Example 1 of EP 828 794 A.

Comparison 1d: 0.60 g of a resin mixture as per Example 1 of EP 655 475 A1 consisting of 16 parts of organopolysiloxane resin of formula $[(CH_3)_3SiO_{1/2}][SiO_2]$ having an average molecular weight of 2000 and an average ethoxy content of 2.1 percent by weight, based on the resin molecule and 17 parts of organopolysiloxane resin of formula $[(CH_3)_2\ SiO]_{0.2}[(CH_3)SiO_{3/2}]_{0.8}$ having an average molecular of 3000 and an average ethoxy content of 2.6 percent by weight, based on the resin molecule.

Comparison 1e: Similarly to Comparison 1d except that KOH is added to the resin mixture and the pH is 11.

Comparison 1f: 0.60 g of a 1:1 mixture of vinyltrimethoxysilane (VTMO) and α,ω-dimethoxypoly(N-(2-aminoethyl)-3-aminopropylmethylsiloxane) as per Example 1 of EP 828 794 A. The results are summarized in table 2:

TABLE 2

| Comparison | Siloxane (1) in g | Replacement of silane (2) in g | by | pH | Appearance of dried emulsion after 24 h/23° C. | 7 days/23° C. |
|---|---|---|---|---|---|---|
| 1a | 99.40 | 0.60 | VTMO[1)] | 5 | oily, thin, clear | oily, thin, clear |
| 1b | 99.40 | 0.34 | VTMO[1)] | 5 | oily, thin, clear | oily, thin, clear |
| 1c | 99.40 | 0.60 | GF95-H[2)] | 10 | oily, thin, cloudy | oily, thin, cloudy |
| 1d | 99.40 | 0.60 | resin[3)] | 5 | oily, thin, cloudy | oily, thin, cloudy |
| 1e | 99.40 | 0.60 | resin[3)] + KOH to pH 11 | 11 | oily, thin, cloudy | oily, thicker, cloudy |
| 1f | 99.40 | 0.60 | VTMO[1)] + GF95-H[2)] | 9[4)] | oily, thin, cloudy | oily, thicker, cloudy |

[1)]vinyltrimethoxysilane
[2)]GF95-H = α,ω-dimethoxypoly(N-(2-aminoethyl)-3-aminopropyl-methylsiloxane)
[3)]resin mixture from Example 1 of EP 655 475 A1 (see description above under Comparison 1d))

None of the emulsions form a film on drying. The oily silicones remaining behind are soluble in toluene (tested as 20% solution in toluene), i.e., they are not crosslinked.

Comparative Test 2

The viscosity increase after mixing the components siloxane (1) and silane (2) as per Example B3, i.e., α,ω-dihydroxypolydimethylsiloxane with morpholinomethyltriethoxysilane, was measured.

For comparison, morpholinomethyltriethoxysilane was replaced by the component reported in table 3, in 2a-2f (similarly to the comparative tests 1a-1f) and again the increase in viscosity was measured.

The results are summarized in table 3.

While the viscosity rises rapidly using the inventive components (1) and (2), similarly to Example 3, and has doubled after 2 hours and is no longer measurable after just 5 hours, because an elastomer is formed, the viscosity in the case of comparative tests V2a-V2e rises only very gradually and even 7 days later crosslinked elastomeric particles are not formed.

TABLE 3

Measurement of viscosity increase

| Comparison | Siloxane (1) in g | Replacement of silane (2) in g | | Viscosity at 23° C. measured with Brookfield [mPa · s] immediately after mixing | after 2 h | after 24 h | after 2 days | after 6 days |
|---|---|---|---|---|---|---|---|---|
| 2a | 99.40 | 0.60 | VTMO[1)] | 5410 | 5740 | 5680 | 5720 | 5810 |
| 2c | 99.40 | 0.60 | GF95-H[2)] | 6100 | 6240 | 6200 | 6200 | 6390 |
| 2d | 99.40 | 0.60 | resin[3)] | 5860 | 5980 | 5960 | 5950 | 6020 |
| 2e | 99.40 | 0.60 | resin[3)] + KOH to pH 11 | 5950 | 6530 | 7480 | 7960 | 9280 |
| 2f | 99.40 | 0.60 | VTMO[1)] + GF95-H[2)] | 5810 | 6580 | 8710 | 12,650 | 36,700 |
| similarly to Example 3 | 99.40 | 0.60 | as per invention: morpholinomethyltriethoxysilane | 350,000 | 736,000 | not measurable, crosslinked, elastic | not measurable, crosslinked, elastic | not measurable, crosslinked, elastic |

Siloxane (1) = polydimethylsiloxanediol containing 1100 weight-ppm of terminal OH groups Comparative Test 3 as per DE 102004038148 A1

In an Ultra-Turrax emulsifying apparatus T 50 (from Janke & Kunkel/IKA), 9.38 g of isotridecyl decaethoxylate (Lutensol TO 109, from BASF AG), 3.90 g of castor oil ethoxylate G 1300 (from Atlas) and 4.55 g of water are combined to prepare a stiff emulsifier mixture, which is admixed with 125.28 g of a freshly prepared homogeneous polymer/silane mixture of 124.63 g of polydimethylsiloxanediol containing 765 weight-ppm of terminal OH groups as organopolysiloxane (1) and 0.86 g of N morpholylmethylmethyldiethoxysilane, added by metering. This is followed by portionwise diluting with altogether 106.65 g of water to obtain a stable emulsion having an average particle size of 275 nm. The silicone content of the emulsion is 50%.

After standing for 24 h/25° C. the emulsion is evaporated and the siloxane polymer is re-extracted with n-heptane to obtain, after evaporation of the solvent, a highly viscous polysiloxane having a viscosity of 3400 Pa·s (25° C.), which is soluble in toluene and hence uncrosslinked. The dispersion containing this highly viscous polysiloxane is not in accordance with the present invention.

Example 7

In an Ultra-Turrax T 50 emulsifying apparatus (from Janke & Kunkel/IKA), 6 g of isotridecyl decaethoxylate, 85% in water, commercially available under the trade name of Lutensol TO 109 (from BASF), and 6 g of ion-free water are combined to prepare an emulsifier mixture which is admixed with 60 g of a freshly prepared homogeneous siloxane polymer/silane mixture consisting of:

33.2% of a polydimethylsiloxanediol (1a) containing 1100 weight-ppm of terminal OH groups, 66.41% of a copolymer of 3-(2-aminoethylamino)propylmethylsiloxy and dimethylsiloxy units (1b) having an amine number of 0.145, a viscosity of 4700 mm2/s (25° C.) and an OH/OMe end group ratio=54/46 and 0.39% of N-morpholinomethyltriethoxysilane as silane (2), added by metering. This is followed by portionwise dilution with altogether 23 g of completely ion-free water to obtain a milkily white emulsion having an average particle size of 210 nm. The emulsion is admixed with 1 g of N-(2-aminoethyl)(3-aminopropyl)methyldimethoxysilane as component (5) and 0.4 g of 80% acetic acid as component (6) by metered addition and stirring. The solids content of the emulsion is 66%, the pH is 7.5. The emulsion is homogeneous and stable even after 6 months of storage at room temperature.

Example 8

To 97 g of the emulsion of Example 7 are gradually metered, with vigorous stirring, 3 g of N-(2-aminoethyl)(3-aminopropyl)-methyldimethoxysilane as further component (5). The solids content of the emulsion is about 66%, the pH is 10.5.

Comparative Test 4

In an Ultra-Turrax T 50 emulsifying apparatus (from Janke & Kunkel/IKA), 6 g of isotridecyl decaethoxylate, 85% in water, commercially available under the trade name of Lutensol TO 109 (from BASF), and 6 g of ion-free water are combined to prepare an emulsifier mixture which is admixed with 60 g of a freshly prepared homogeneous siloxane polymer/silane mixture consisting of 33.2% of a polydimethylsiloxanediol (1a) containing 1100 weight-ppm of terminal OH groups, 66.41% of a copolymer of 3-(2-aminoethylamino) propylmethylsiloxy and dimethylsiloxy units (1b) having an amine number of 0.145, a viscosity of 4700 mm2/s (25° C.) and an OH/OMe end group ratio=54/46.

This is followed by portionwise dilution with altogether 23 g of completely ion-free water to obtain a milky white emulsion having an average particle size of 210 nm. The emulsion is admixed with 1 g of N-(2-aminoethyl)(3-aminopropyl) methyldimethoxysilane as component (5) and 0.4 g of 80% acetic acid as further component (6) by metered addition and stirring. The solids content of the emulsion is 66%, the pH is 7.5. The emulsion is homogeneous and stable even after 6 months of storage at room temperature.

Comparative Test 5

To 97 g of the emulsion of Comparative test 4 are gradually metered, with vigorous stirring, 3 g of N-(2-aminoethyl)(3-aminopropyl)-methyldimethoxysilane as further component (5). The solids content of the emulsion is about 66%, the pH is 10.5.

Testing of film formation of emulsions of Examples 7 and 8 and Comparative tests 4 and 5:

In accordance with the film-testing method described above, the emulsions of Examples 7 and 8 and Comparative tests 4 and 5 were diluted, weighed into a lid and dried at 23° C./24 h or at 120 or 170° C. for 20 min each. The results are summarized in table 4.

While the emulsions of Comparative tests 4 and 5, (even when the amount of N-(2-aminoethyl)(3-aminopropyl)methyldimethoxysilane is increased) dry to leave an oily residue, the inventive emulsions of Examples 7 and 8 form a firm film not only at 23° C., but also at 120° C. and also at 170° C. Shortly after drying, the film comprising an increased proportion of N-(2-aminoethyl)(3-aminopropyl)methyldimethoxysilane (Example 8) is still very slightly tacky, but becomes dry on storage.

When dried at 120° C., the films remain free of yellowing, while at 170° C. it is possible to observe slight yellowing or marked yellowing in the case of an increased amount of N-(2-aminoethyl)(3-aminopropyl)methyldimethoxysilane.

The emulsions of Examples 7 and 8 thus achieve crosslinking at low temperature without yellowing, and provide a higher molecular weight network with film character than the emulsions of Comparative tests 4 and 5.

TABLE 4

Comparison of film formation

| | Film property ratings* | | | Appearance | |
|---|---|---|---|---|---|
| | 23° C. | 120° C. | 170° C. | 23° C., 120° C. | 170° C. |
| Example 7 | 4-5 | 5 | 5 | transparent | yellowish |
| Example 8 | 4 | 4-5 | 4-5 | transparent | yellow |
| Example 4 | 1 | 1 | 1 | transparent | yellowish |
| Example 5 | 1 | 1 | 1 | transparent | yellow |

*Ratings: 1 = oily, uncrosslinked, 2 = oily, viscid, 3 = viscous, incipiently crosslinked, 4 = elastic, incipiently crosslinked, tacky, 5 = elastic, crosslinked with tack-free dry surface. Films awarded a rating of 4 or 5 are insoluble in toluene.

Finishing of fiberfill fibers with the emulsions of Examples 7 and 8 and Comparative tests 4 and 5:

The emulsions of Examples 7 and 8 and Comparative tests 4 and 5 were each used to finish crimped polyester staple fibers having a linear density of 61 dtex and a staple length of 50 mm in accordance with the lab description, and the fibers were dried at 3 different temperatures of 23°, 120° and 170°.

After drying, the finished fibers were conditioned for 24 hours in a conditioning chamber at 23° C. 50% relative humidity and manually assessed by 5 people for hand (dryness, softness, slippiness, bulk and resiliency). To this end, the samples were lined up according to the hand appraisal and a rating scale was established from 1 to 5 where 5 is the softest, most gliding, springy hand with best resiliency and 1 is a dry hand with noticeable permanent deformation and low resiliency.

The results are summarized in table 5.

The hand of the fibers finished with Examples 7 and 8 is judged to be soft, gliding, of low friction and full (bulky). More particularly, the good hand is distinctly improved over the noninventive Comparative tests 4 and 5 at room temperature, but in particular at 120° C. drying.

TABLE 5

Comparison of hand of crimped polyester staple fibers finished with the following emulsions:

| Finishing agent | Hand after drying at 23° C. | 120° C. | 170° C. |
|---|---|---|---|
| Example 7 | 2.5 | 3.5 | 4.5 |
| Example 8 | 3.5 | 4 | 5 |
| Comparison 4 | 1.5 | 2 | 3 |
| Comparison 5 | 1.5 | 2 | 3 |

The finished fibers were divided and one half of the samples were enclosed in a laundry bag and washed with a mild detergent at 40° C. (colored setting). After washing, the bags were emptied and the fibers were dried and conditioned in a conditioning chamber at 23° C. 50% relative humidity. The washed samples were then manually assessed for hand against each other (ratings 1 to 5; 5 the most gliding, most bulky hand).

The results are summarized in table 6.

TABLE 6

Comparison of hand of finished polyester staple fibers after mild washing

| Finishing agent | Hand after washing: Drying at 120° C. | 170° C. |
|---|---|---|
| Example 7 | 3 | 3.5 |
| Example 8 | 3.5 | 4 |
| Comparison 4 | 1.5 | 2 |
| Comparison 5 | 1.5 | 2.5 |

After washing, the hand of the fibers treated with Examples 7 and 8 is distinctly better than in the case of the fibers treated with Comparative tests 4 and 5. The permanence of the finish on the fiber to hexane as organic cleaning agent was tested by extracting the fiber in a Soxhlet apparatus for 3 hours and determining the amount extracted. The results are summarized in table 7.

TABLE 7

Comparison of hexane extractables of finished fibers.

| Finishing Agent | Extracted amount 3 h with boiling hexane Drying at 170° C. |
|---|---|
| Example 7 | 1.78% |
| Example 8 | 1.61% |
| Comparison 4 | 2.26% |
| Comparison 5 | 2.01% |

The extractables are distinctly lower at 1.78% and 1.61% in the case of Examples 7 and 8 than in the case of the noninventive Comparative tests 4 and 5, and hence evidence for higher permanence, including to organic solvent, of the inventive silicone film formed on the fiber.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A process for treating fiberfill fibers, comprising contacting the fibers with an aqueous dispersion of partially crosslinked solid organopolysiloxane particles obtained by reaction of organopolysiloxanes (1) comprising condensation-capable groups and units of the formula $$R_a(OR^1)_bSiO_{\frac{4-(a+b)}{2}} \quad (1)$$

where

R is a hydrogen atom or a monovalent hydrocarbyl moiety of 1 to 18 carbon atoms which is optionally substituted with the heteroatoms N and/or O, $R^1$ is a hydrogen atom or an alkyl moiety with 1 to 8 carbon atoms, a is 0, 1, 2 or 3, and b is 0, 1 or 2, with the proviso that the sum a+b is ≦3 and the organopolysiloxane (1) contains on average at least one $OR^1$ moiety per molecule, with silanes (2) of the formula $$(R^3O)_3SiCR^2{}_2—Y \quad (II)$$

or their hydrolyzates, where $R^2$ is a hydrogen atom or a monovalent alkyl moiety of 1 to 4 carbon atoms, $R^3$ is an alkyl moiety having 1 to 8 carbon atoms per moiety, Y is a moiety of the formula —$NHR^4$, —$NR^4{}_2$ or —$NR^5$, where $R^4$ is a monovalent hydrocarbyl moiety of 1 to 18 carbon atoms which optionally contains nitrogen and/or oxygen atoms, and $R^5$ is a divalent hydrocarbyl moiety of 3 to 12 carbon atoms which optionally contains nitrogen and/or oxygen atoms, in the presence of water (3), emulsifier (4)

and optionally further silanes (5) of the formula $$(R^3O)_xR_{3-x}Si—R^6—Z \quad (III)$$

or their hydrolyzates, where $R^6$ is a divalent hydrocarbyl moiety of 3 to 18 carbon atoms and Z is a moiety selected from the group consisting of amino or aminoalkylamino moieties, epoxy moieties and (meth)acryloyloxy radicals, and x is 1, 2 or 3, and optionally further materials (6) which do not take part in the reaction of organopolysiloxane (1) with silane (2), wherein silane (2) is used in such amounts that 0.6 to 2 equivalents of —$OR^3$ are present per equivalent of —$OR^1$ in organopolysiloxane (1), and with the proviso that no metal-containing catalysts are used and that the organopolysiloxanes (1) and silanes (2) are used in such amounts that the organopolysiloxane particles, after removal of water (3), form crosslinked elastomeric films insoluble in toluene.

2. The process of claim 1, wherein silane (2) is used in such amounts that 0.65 to 1 equivalents of —$OR^3$ are present per equivalent of —$OR^1$ in organopolysiloxane (1).

3. The process of claim 1, wherein fiberfill fibers comprise fiberfill fibers of polyester, polyamide, polylactate (PLA), polybutyric acid, polyolefins, viscose, modal and lyocell.

4. The process of claim 1, wherein organopolysiloxanes (1) comprise those of the formula $$(R^1O)R_2SiO(SiR_2O)_eSiR_2(OR^1) \quad \text{(IV)},$$

where R and $R^1$ are each as defined in claim 1 and e is an integer from 1 to 1000, with the proviso that 50 to 100% of all $R^1$ moieties are hydrogen atoms.

5. The process of claim 2, wherein organopolysiloxanes (1) comprise those of the formula $$(R^1O)R_2SiO(SiR_2O)_eSiR_2(OR^1) \quad \text{(IV)},$$

where R and $R^1$ are each as defined in claim 1 and e is an integer from 1 to 1000, with the proviso that 50 to 100% of all $R^1$ moieties are hydrogen atoms.

6. The process of claim 1, wherein $R^2$ is a hydrogen atom.

7. The process of claim 2, wherein $R^2$ is a hydrogen atom.

8. The process of claim 4, wherein $R^2$ is a hydrogen atom.

9. The process of claim 1, comprising applying the aqueous dispersions to the fiberfill fibers by spraying, dipping, padding, or curtain coating.

10. The process of claim 1, comprising applying the aqueous dispersions to the fiberfill fibers and subsequently removing water (3) from the dispersions whereupon elastomeric films insoluble in toluene are formed.

11. The process of claim 10, comprising removing water (3) by allowing the fiberfill fibers treated with the aqueous dispersions to dry at a temperature of 1 to 230° C.

12. The process of claim 10, comprising removing water (3) by allowing the fiberfill fibers treated with the aqueous dispersions to dry at a temperature of 30 to 180° C.

13. The process of claim 10, comprising removing water (3) by allowing the fiberfill fibers treated with the aqueous dispersions to dry at a temperature of 70 to 120° C.

14. The process of claim 1, wherein each $R^1$ is a moiety individually selected from the group consisting of hydrogen, methyl and ethyl moieties.

* * * * *

UNITED STATES PATENT AND TRADEMARK OFFICE

CERTIFICATE OF CORRECTION

PATENT NO. : 8,304,023 B2
APPLICATION NO. : 11/936279
DATED : November 6, 2012
INVENTOR(S) : Konrad Alfons Wierer et al.

It is certified that error appears in the above-identified patent and that said Letters Patent is hereby corrected as shown below:

Column 18, Line 61, Claim 1:

After "(meth)acryloloxy" delete "radicals" and
Insert -- moieties --.

Signed and Sealed this
Ninth Day of April, 2013

Teresa Stanek Rea
*Acting Director of the United States Patent and Trademark Office*